US005794762A

United States Patent [19]

Tsai

[11] Patent Number: 5,794,762

[45] Date of Patent: Aug. 18, 1998

[54] KEY SWITCH STRUCTURE

[75] Inventor: Ching Cheng Tsai, Chi Lung, Taiwan

[73] Assignee: Chicony Electronics Co., Ltd., Taipei Hsien, Taiwan

[21] Appl. No.: 798,631

[22] Filed: Feb. 11, 1997

[51] Int. Cl.[6] ..... H01H 13/70

[52] U.S. Cl. ..... 200/345

[58] Field of Search ..... 200/54, 512, 513, 200/514, 515, 516, 517, 341, 342, 343, 344, 345, 306

[56] References Cited

U.S. PATENT DOCUMENTS

| | | | |
|---|---|---|---|
| 4,939,324 | 7/1990 | English et al. | 200/345 |
| 5,283,408 | 2/1994 | Chen | 200/345 |
| 5,442,152 | 8/1995 | Huang | 200/345 |
| 5,456,541 | 10/1995 | Ching-Shui | 200/345 |
| 5,496,982 | 3/1996 | Tsai | 200/345 |

*Primary Examiner*—Khanh Dang
*Attorney, Agent, or Firm*—Morton J. Rosenberg; David I. Klein; Jun Y. Lee

[57] ABSTRACT

A key switch assembly for use in a keyboard employing pressure sensitive electric switches disposed within a keyboard housing is provided. The key switch assembly includes a key switch socket member integrally formed on an upper panel of the keyboard housing to project axially upward therefrom. The key switch socket member includes an inner wall portion defining a receiving bore which has formed thereon an axially extended guiding slot spaced from a pair of appropriately spaced and radially protruding guiding projections which are provided with upwardly exposed beveled surfaces. The key switch assembly also includes a key top member displaceably coupled to the key switch socket member which is formed with an axially extended key stem. The key stem is coaxially received through the receiving bore of the key switch socket member and includes an outer surface portion on which are formed a pair of axially extended guiding rails slidably engaged respectively by the guiding projections of the key switch socket member and a radially protruding guiding rib which slidably engages the guiding slot of the key switch socket member. A pair of resilient projections are provided on the key stem to resiliently engage respectively the guiding projections of the key switch socket member.

3 Claims, 4 Drawing Sheets

KEY SWITCH STRUCTURE

FIELD OF THE INVENTION

The present invention relates to a key switch, more particularly, to an improved key switch which is user friendly and easy to install.

DESCRIPTION OF PRIOR ART

Referring to FIG. 1, an exploded perspective view for a conventional key switch is shown. In the conventional keyboard, the upper panel 10*a* is provided with a plurality of key switch socket 11*a*. The key switch socket 11*a* has a hollow rectangular configuration for slidably receiving a key top 12*a* thereon. The bottom of the key top 12*a* is provided with a key stem 13*a* having also a rectangular configuration. Each of the corners of the key stem 13*a* of the key top 12*a* is provided with a post 14*a*. A elastic plate 15*a* is further provided adjacent to the post 14*a* such that the key stem 13*a* can be readily and slidably engaged with the key switch socket 11*a*. The post 14*a* serves a lubricator to reduce the frictional force between the key stem 13*a* and the key switch socket 11*a*. The key stem 13*a* may move up and down within the key switch socket 11*a* as it is depressed by a finger of a user. Consequently, the rubber base 16*a* disposed at lower portion of the key stem 13*a* my selectively actuate a switch disposed thereunder.

Nevertheless, the matching clearance between the key stem 13*a* and the key switch socket 11*a* shall be precisely selected to ensure the key stem 13*a* may be readily moved with respect to the key switch socket 11*a*. If the clearance is not correctly selected or machined, the key stem 13*a* will be jammed within the key switch socket 11*a*. If the clearance is too large, the key stem 13*a* will roll and pitch with respect to the key switch socket 11*a*. In this case, the assembling of the key stem 13*a* to the key switch 11*a* will be difficult and a defective product will be resulted, i.e. the key stem 13*a* will be jammed within the key switch socket 11*a* or the key stem 13*a* will roll and/or pitch with respect to the key switch socket 11*a*. Consequently, the manufacturing cost is considerably increased.

In light of this, there is still a room for improving the key switch.

SUMMARY OF THE INVENTION

It is the objective of this invention to provide an improved key switch structure wherein the problems encountered by the conventional key switch can be advantageously solved.

In order to achieve the object set forth, the improved key switch structure made according to the present invention generally comprises a key switch socket and a key top. The key switch socket is integrally formed on the upper panel of the keyboard. The key switch socket has a cylindrical configuration defining a receiving space therein. The inner wall of the key switch socket is provided with a pair of fixed guiding projections directed inward. Each of the projections is further includes bevel surface. A key top which can be readily and slidably received within the key switch socket is provided. A key stem having cylindrical configuration is provided at the bottom portion of the key top wherein the key stem can be moved down and up within the key switch socket. The outer surface of the key stem is provided with a pair of guiding rails corresponding to the guiding projections of the key switch socket. The lower portion of the guiding rail is provided with a gap which in turn provides elasticity to the lower portion of the guiding rail. The inner lower end portion of the guiding rails is provided with an elastic projection. Wherein the key stem of the key top can be readily and slidably received within the key switch socket and guided by the guiding projection of the key switch socket and the guiding rails of the key stem. Since the guiding rails are inherited with elasticity, consequently, the guiding rails may stable the vertical movement of the key stop. On the other hand, the guiding rails may also contact with the guiding projections of the key switch socket, consequently, the jam therebetween can be advantageously avoided as the frictional force is reduced or eliminated. Furthermore, the rolling or pitching of the key stem respect to the key switch socket can also be avoided. In conclusion, the key top can be more easily installed onto the key switch socket without any problems encountered by the conventional one.

BRIEF DESCRIPTION OF THE DRAWINGS

In order that the present invention may more readily be understood the following description is given, merely by way of example with reference to the accompanying drawings, in which.

BRIEF DESCRIPTION OF NUMERALS

Figure 1:
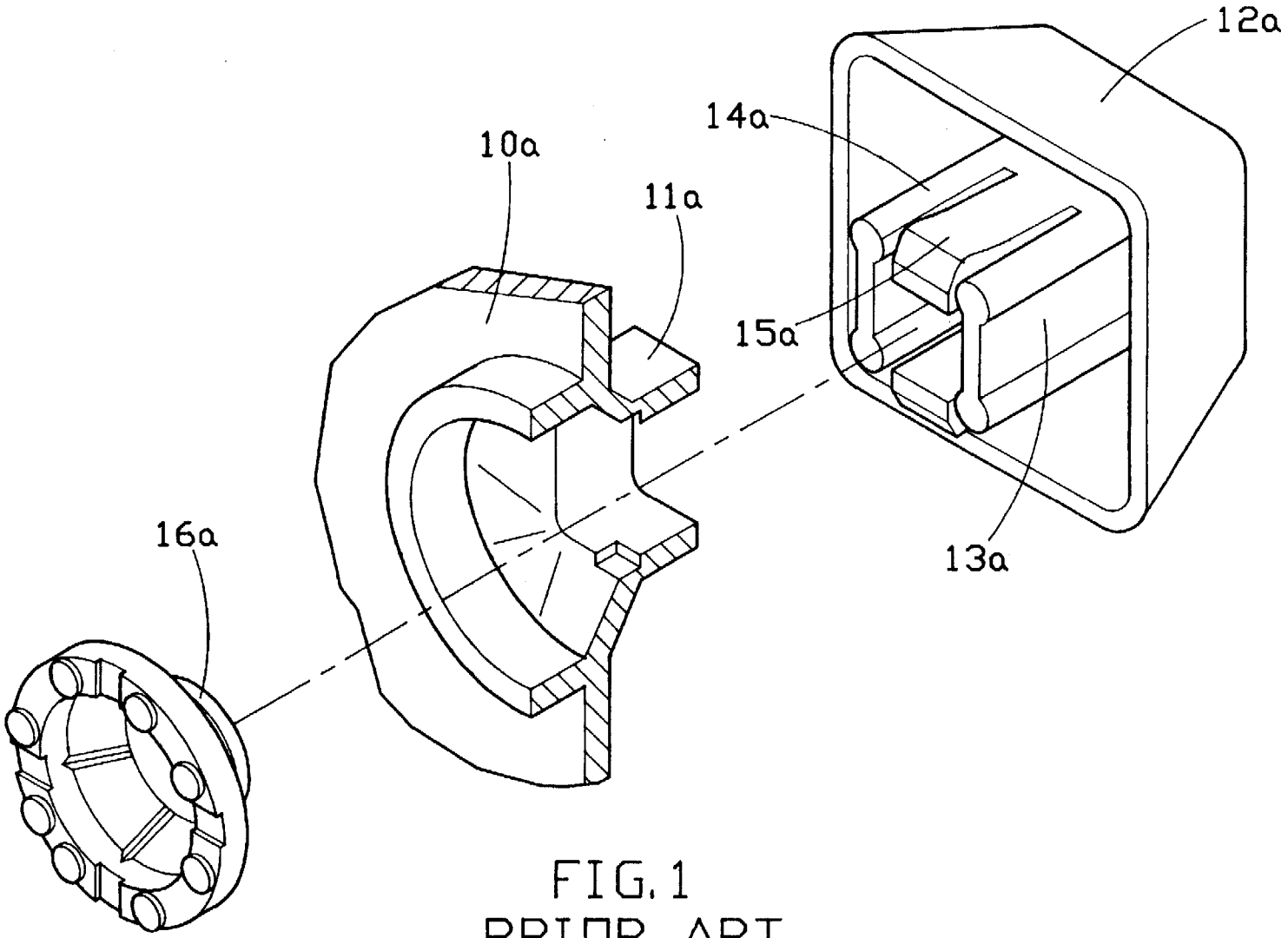
FIG. 1 PRIOR ART
FIG. 1 is an exploded perspective view of a conventional key switch.

11 upper panel of keyboard
12 guiding projection
13 bevel surface
14 guiding slot
20 key cap
21 key stem
22 guiding rail
23 gap
24 resilient projection
25 curved surface
26 guiding rib
31 pressing portion
40 membrane switch
50 bottom plate
10*a* upper panel of keyboard
11*a* key switch socket
12*a* key top
13*a* key stem
14*a* post
15*a* resilient plates

DETAILED DESCRIPTION OF PREFERRED EMBODIMENT

Figure 2:
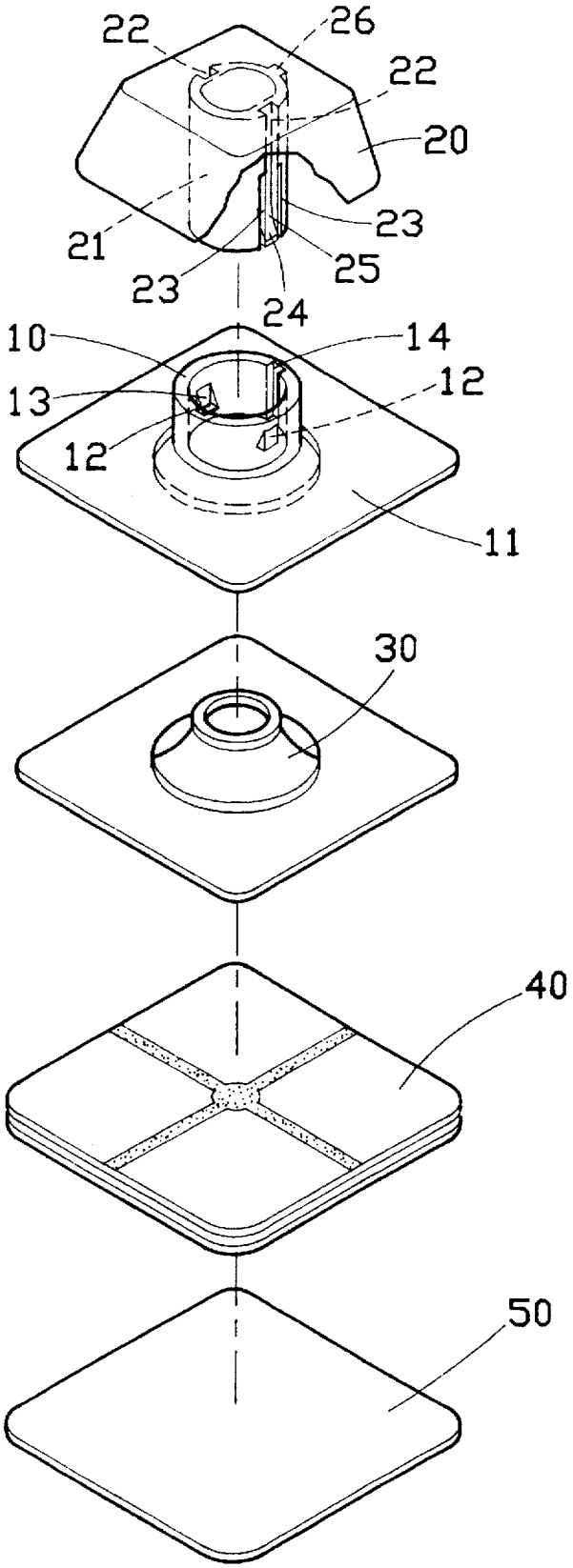
FIG. 2 is an exploded perspective view of the key switch made according to the present invention.
Figure 3:
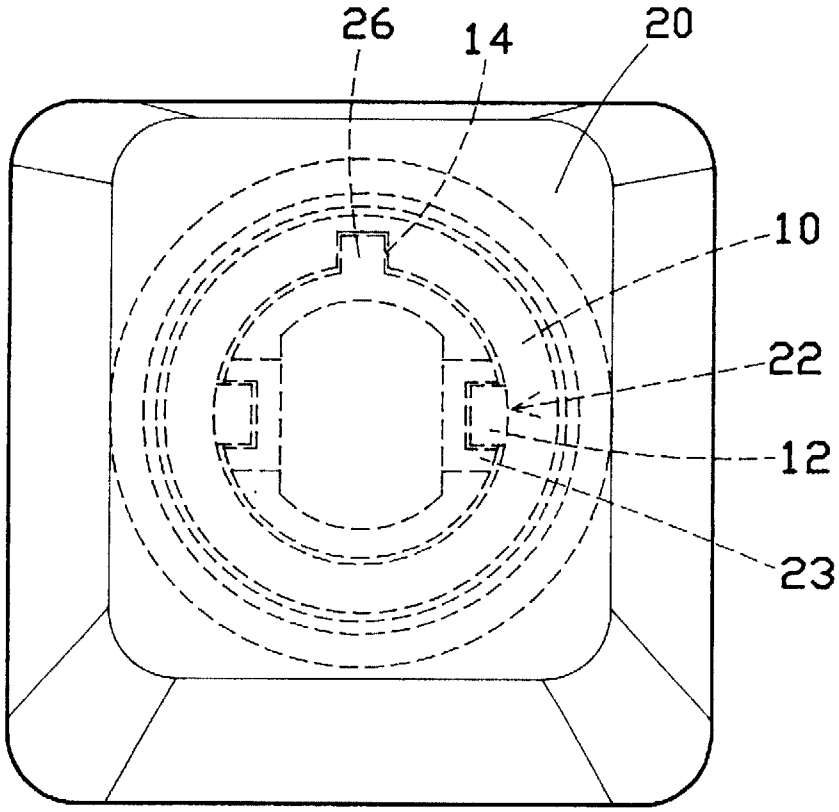
FIG. 3 is a cross sectional view of the key switch shown in FIG. 2.
Figure 4:
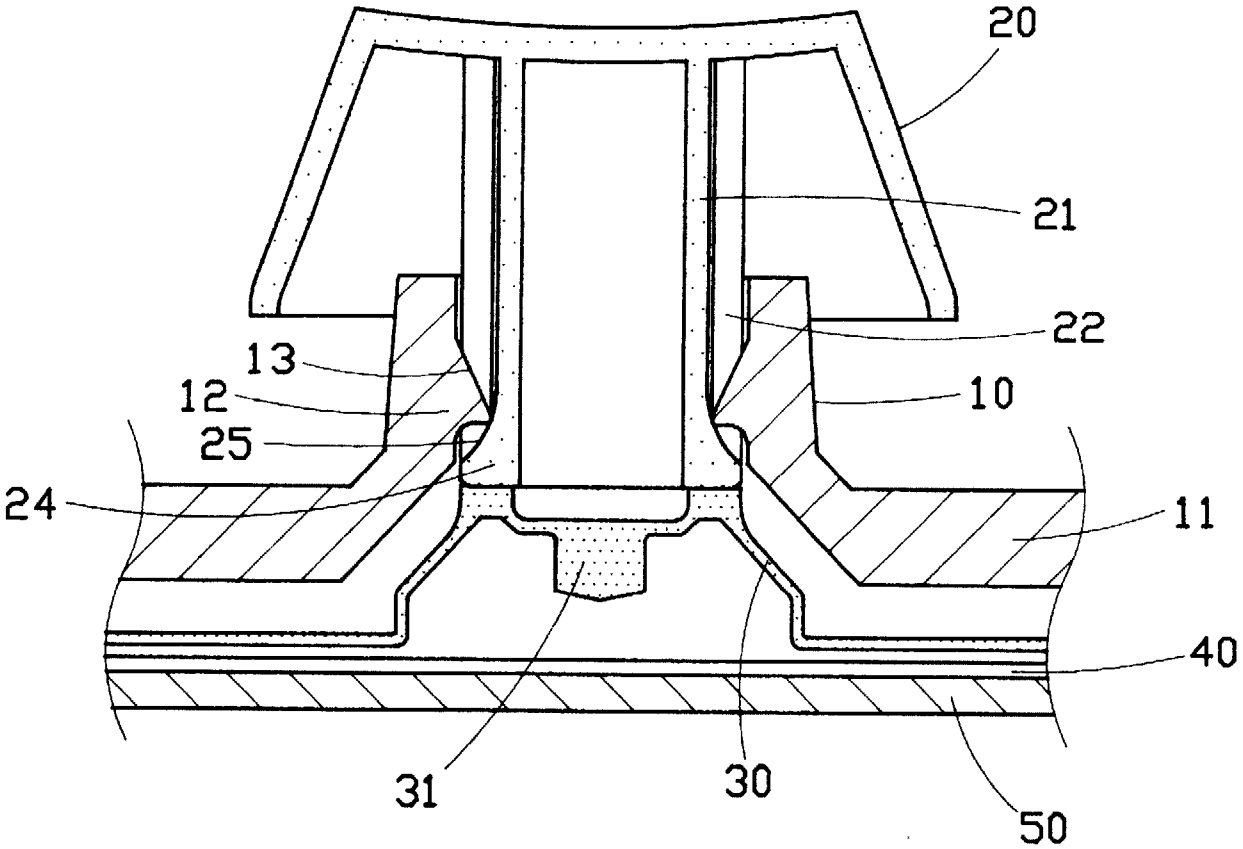
FIG. 4 is a top plan view of the key switch shown in FIG. 2.

Referring to FIGS. 2, 3, and 4, showing the key switch structure made according to the present invention in exploded perspective view, cross sectional view and top plan view. The key switch made according to the present invention generally comprises a key switch socket 10 and a key top 20. The key switch socket 10 is integrally formed on the upper panel 11 of the keyboard. The key switch socket 10 has a cylindrical configuration defining a receiving space therein. The inner wall of the key switch socket 10 is provided with a pair of fixed guiding projections 12 directed inward. Each of the projections 12 is further includes bevel surface 13. The inner wall of the key switch socket 10 can be further provided with at least a guiding slot 14. In the preferred embodiment of the present invention, one guiding slot 14 is provided.

A key top 20 can be readily and slidably received by the key switch socket 10. A key stem 21 is provided at the bottom portion of the key top 20 and the key stein 21 can be moved down and up within the key switch socket 10 when it is depressed by the finger of the user. The outer surface of the key stem 21 is provided with a pair of guiding rails 22 corresponding to the guiding projections 12 of the key switch socket 10. The lower portion of the guiding rail 22 is provided with a pair of gaps 23 directed downward. By this arrangement, the lower portion of the guiding rail 22 is provided with resiliency. The inner lower end portion of the guiding rails 22 is thus provided with a resilient projection 24 having a curve surface 25 thereof. The outer surface of the outer surface of the key stem 21 is provided with a guiding rib 26 corresponding to the guiding slot 14 of the key switch socket 10. By this arrangement, the key top 20 can be correctly install onto the key switch socket 10 without the possibility of mistake.

The key stem 21 of the key top 20 is slidably received within the key switch socket 10 such that the guiding projections 12 of the key switch socket 10 is slidably engaged with the guiding rails 22 of the key stem 21 and the guiding slot 14 of the key switch socket 10 is also cooperatively engaged with the guiding ribs 26 of the key stem 21 such that the key stem 21 may move vertically down and up within the key switch socket 10.

As clearly shown in FIG. 3, when the key top 20 is depressed, the key stem 21 is moved downward such that the pressing portion 31 of the elastic actuating member 30 will actuate the membrane switch 40 disposed at the upper surface of the bottom plate 50, i.e. the switch is On. When the external force is released, the key top 20 is bounced back by the potential force of the elastic actuating member 30 such that the member switch 40 is resumed to opened position as the pressing portion 31 is removed therefrom, i.e. the switch is resumed to Off. By this arrangement, the member switch can be selectively switched on by the downward movement of the key stem 21 of the key top 20. Since the elastic actuating member 30 and the membrane 40 are known to the skilled in the art, accordingly, not detailed description is given.

Since the key switch socket 10 and the key stem 21 all have the cylindrical configuration which can be readily and centrally positioned. On the other hand, the key stem 21 can be readily guided for vertical movement within the key switch socket 10 by the help of the guiding projections 12 and the guiding rails 22.

Besides, the key stem 21 can be further stabled for vertical movement by the guiding slot 14 and the guiding ribs 26. On the other hand, the guiding projection 12 of the key switch socket 10 is provided with bevel surface 13 and the guiding rails 22 and the resilient projection 24 are all with elasticity, consequently, the guiding projections 12 can be readily received within the guiding rails 22 of the key stem 21. In light of this, the assembling can be readily done.

Besides, in use of the key switch of the present invention, when the key stem 21 is moved upward, the resilient projection 24 of the key stem 20 is limited by the guiding projection 12 of the key switch socket 10, accordingly, the key stem 21 will not escape from the key switch socket 12. On the other hand, the resilient projection 24 is provided with curve surface 25 which serves as a buffer, consequently, the noise generated from contact between the resilient projection 24 and the guiding projection 12 can be reduced or even eliminated.

Since the guiding rails 22 are provided with a resilient structure, consequently, the guiding rails 22 may stable the vertical movement of the key stop 21. On the other hand, the guiding rails 22 may also contact with the guiding projections 12 of the key switch socket 10, consequently, the jam therebetween can be advantageously avoided as the frictional force is reduced or eliminated. Furthermore, the rolling or pitching of the key stem 21 respect to the key switch socket 10 can also be avoided. In conclusion, the key top 20 can be more easily installed onto the key switch socket 10 without any problems encountered by the conventional one.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A key switch assembly for a keyboard having pressure-sensitive electric switching means disposed within a keyboard housing, said key switch assembly comprising:

(a) a key switch socket member integrally formed on an upper panel of said keyboard housing, said key switch socket member having an inner wall portion defining a receiving bore projecting axially in an upward direction from the plane of said keyboard housing upper panel, said inner wall portion having formed thereon in spaced manner an axially extended guiding slot and a pair of radially protruding guiding projections, each of said guiding projections being formed with an upwardly exposed bevelled surface; and, (b) a key top member displaceably coupled to said key switch socket member for actuating responsive to user actuation thereof said pressure-sensitive electric switching means, said key top member having an axially extended key stem coaxially received in said receiving bore of said key switch socket member, said key stem including:

(1) an outer surface portion, said outer surface portion having formed thereon in spaced manner a pair of axially extended guiding rails and a radially protruding guiding rib, said guiding rails being slidably engaged respectively by said guiding projections of said key switch socket member, said guiding rib slidably engaging said guiding slot of said key switch socket member; and, (2) a pair of resilient projections disposed respectively within said guiding rails, each of said resilient projections being suspended substantially within one of said guide rails and extending axially downward to terminate at an end section, said end section being adapted to resiliently engage one of said guiding projections of said key switch socket member.

2. The key switch assembly as recited in claim 1 wherein said end section of each said key top member key stem includes an outwardly directed arcuate surface for engaging said guiding projections of said key switch socket member.

3. The key switch assembly as recited in claim 2 wherein said key stem and said key switch socket member are each characterized by a substantially cylindrical outer contour.

* * * * *